US006868898B2

(12) United States Patent
Chau et al.

(10) Patent No.: US 6,868,898 B2
(45) Date of Patent: Mar. 22, 2005

(54) HEAT PIPE HAVING AN INNER RETAINING WALL FOR WICKING COMPONENTS

(75) Inventors: David S. Chau, Chandler, AZ (US); Ioan Sauciuc, Phoenix, AZ (US)

(73) Assignee: Intel Corporation, Santa Clara, CA (US)

( * ) Notice: Subject to any disclaimer, the term of this patent is extended or adjusted under 35 U.S.C. 154(b) by 27 days.

(21) Appl. No.: 10/400,743

(22) Filed: Mar. 26, 2003

(65) Prior Publication Data

US 2004/0188067 A1 Sep. 30, 2004

(51) Int. Cl.[7] ..... F28D 15/00

(52) U.S. Cl. ..... 165/104.26; 165/185; 361/700; 174/15.2

(58) Field of Search ..... 165/104.26, 104.21, 165/104.33, 185; 361/700; 174/15.2; 257/714–716

(56) References Cited

U.S. PATENT DOCUMENTS

| | | | | |
|---|---|---|---|---|
| 3,604,503 A | * | 9/1971 | Feldman et al. | 165/96 |
| 4,345,642 A | * | 8/1982 | Ernst et al. | 165/86 |
| 4,793,404 A | * | 12/1988 | Hata | 165/104.26 |
| 5,560,423 A | | 10/1996 | Larson et al. | |
| 5,646,822 A | * | 7/1997 | Bhatia et al. | 361/687 |
| 5,647,429 A | * | 7/1997 | Oktay et al. | 165/104.26 |
| 5,697,434 A | * | 12/1997 | Burward-Hoy | 165/185 |
| 5,785,088 A | * | 7/1998 | Pai | 138/38 |
| 6,296,622 B1 | * | 10/2001 | Kurz et al. | 604/93.01 |
| 6,446,706 B1 | * | 9/2002 | Rosenfeld et al. | 165/46 |
| 6,619,384 B2 | * | 9/2003 | Moon et al. | 165/104.26 |
| 2002/0139517 A1 | * | 10/2002 | Choi et al. | 165/104.26 |
| 2003/0000681 A1 | * | 1/2003 | Reisfeld | 165/104.26 |

FOREIGN PATENT DOCUMENTS

| | | | |
|---|---|---|---|
| EP | 0 306 531 A1 | 3/1989 | |
| JP | 57169598 | 10/1982 | |
| JP | 58110991 | 7/1983 | |
| JP | 58110992 | 7/1983 | |
| JP | 58110993 | 7/1983 | |
| JP | 59035785 | 2/1984 | |
| JP | 59-221591 | * 12/1984 | 165/104.26 |

* cited by examiner

*Primary Examiner*—Terrell McKinnon
(74) *Attorney, Agent, or Firm*—Blakely, Sokoloff, Taylor & Zafman LLP

(57) ABSTRACT

A heat pipe is provided, which includes at least one outer structural wall, a wicking structure, and an inner retaining wall for the wicking structure. The outer structural wall has condenser, intermediate, and evaporator sections sequentially after one another. The wicking structure includes a plurality of wicking components onto which a fluid condenses at the condenser section when heat transfers therefrom out through the condenser section, flows thereon through the intermediate section, and evaporates therefrom when heat transfers thereto through the evaporator section. The wicking components are held in place between the intermediate section and an outer surface of the inner retaining wall. The fluid evaporating from the evaporator section recirculates past an inner surface of the inner retaining wall to the condenser section.

28 Claims, 2 Drawing Sheets

HEAT PIPE HAVING AN INNER RETAINING WALL FOR WICKING COMPONENTS

BACKGROUND OF THE INVENTION

1) Field of the Invention

This invention relates to a heat pipe.

2) Discussion of Related Art

Heat pipes are used in electronics and other industries for transferring heat from one location to another. An advantage of using heat pipes is that they can usually transfer more heat efficiently than what can be conducted through a solid metal component having the same cross-sectional area.

A heat pipe typically has an outer structural wall having condenser, intermediate, and evaporator sections sequentially after one another, and a wicking structure within the outer structural wall. A recirculation path is defined wherein a vapor in the condenser section condenses onto the wicking structure when heat is transferred therefrom out of the condenser section, subsequently flows under capillary action and as a liquid through small spaces in the wicking structure to the evaporator section, and then evaporates from the evaporator section when heat is transferred through the evaporator section thereto, whereafter the resulting vapor returns through a center of the heat pipe back to the condenser section.

The wicking structure is often in the form of elongate wicking wires that are attached to an inner surface of the outer structural wall. The elongate wicking wires move relative to one another when the heat pipe is bent, which modifies the sizes of the small spaces between the elongate wicking wires. Capillary forces that move the liquid through the small spaces are destroyed when the sizes of the small spaces increase, resulting in a reduction in flow through the intermediate section and a reduction in heat that is transferred.

BRIEF DESCRIPTION OF THE DRAWINGS

The invention is described by way of example with reference to the accompanying drawings, wherein.

DETAILED DESCRIPTION OF THE INVENTION

Figure 1:
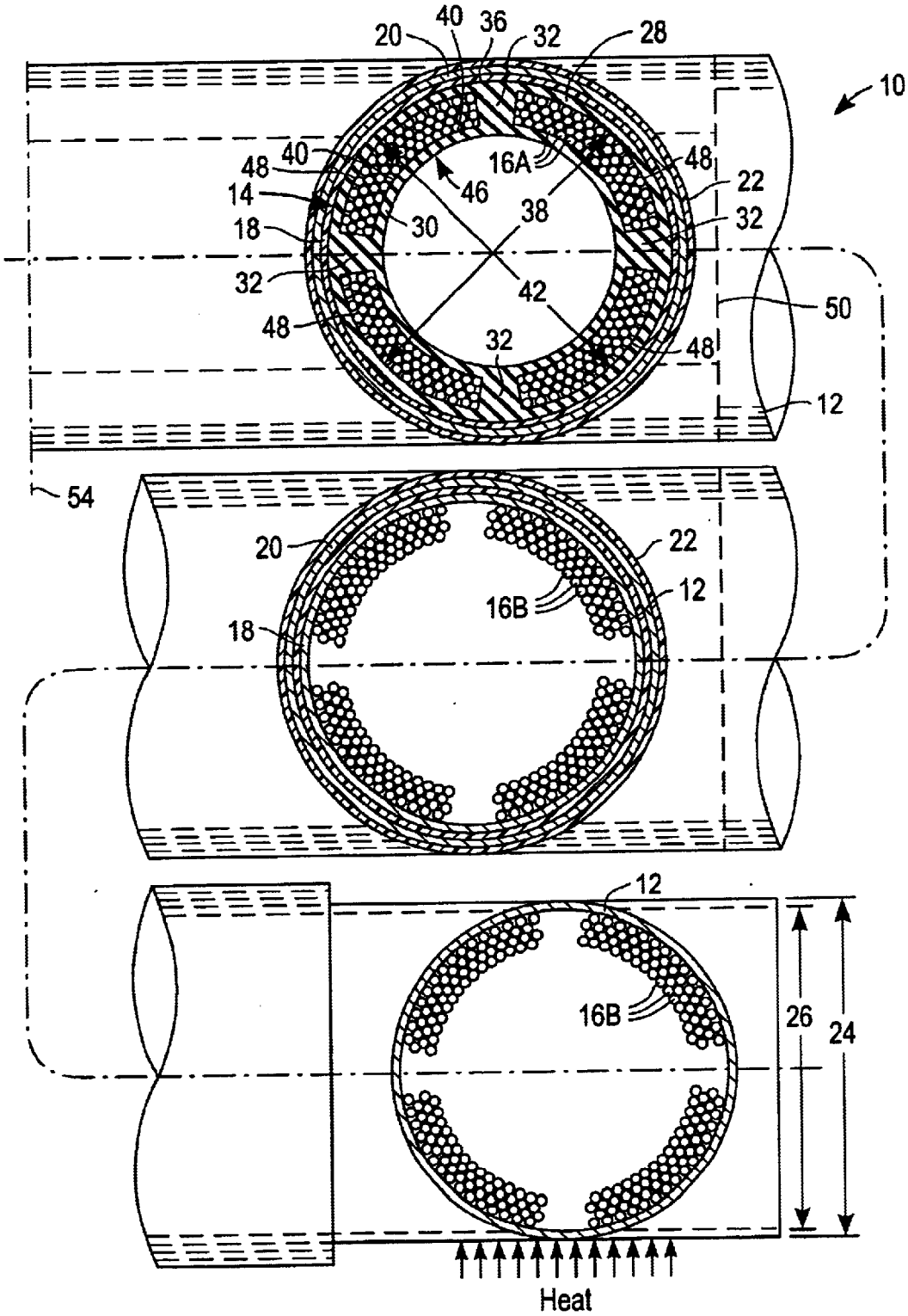
FIG. 1 is a side view of one-half of a heat pipe, according to an embodiment of the invention, illustrating cross-sections at three locations through the heat pipe.

FIG. 1 of the accompanying drawings illustrates one-half of a heat pipe 10 according to an embodiment of the invention, including an evaporator section 12, an intermediate structure 14, elongate wicking wires 16, a plastic outer structural wall protector 18, a metal foil transition sheath 20, and a plastic transition sheath protector 22.

The evaporator section 12 is in the form of a high-stiffness circular (in this example), tubular copper or other metal tube with a high thermal conductivity. The evaporator section 12 has an outer diameter 24 and an inner diameter 26.

The intermediate structure 14 includes an intermediate section 28, an inner retaining wall 30, and four connecting pieces 32. The intermediate section 28, inner retaining wall 30, and connecting pieces 32 are all simultaneously molded from a soft, pliable (low-stiffness) plastics (nonmetal) material having a relatively low thermal conductivity. The intermediate section 28 and the inner retaining wall 30 are in the form of circular, tubular walls. The connecting pieces 32 secure the inner retaining wall 30 to the intermediate section 28 and align the inner retaining wall 30 concentrically with respect to the intermediate section 28.

The intermediate section 28 has an outer surface 36 forming an outer diameter 38 thereof, and an inner surface 40 having an inner diameter 42. The inner retaining wall 30 has a circular outer surface 44 and a circular inner surface 46. Four spaces 48 are defined between the outer surface 44 of the inner retaining wall 30 and the inner surface 40 of the intermediate section 28. The spaces 48 are separated from one another by the connecting pieces 32.

An end of the evaporator section 12 is positioned adjacent an end of the intermediate structure 14 at an interface 50 to form one continuous wall structure. The outer diameter 24 and the inner diameter 26 of the evaporator section 12 correspond respectively to the outer diameter 38 and the inner diameter 42 of the intermediate section 28. There is thus no step from the intermediate section 28 to the evaporator section 12, either internally or externally.

The elongate wicking wires 16 are inserted into the evaporator section 12 and the intermediate structure 14, so that intermediate portions 16A thereof are located within the spaces 48, and evaporator portions 16B thereof are located against an inner surface of the evaporator section 12. The elongate wicking wires 16 transition directly from the inner surface 40 onto an inner surface of the evaporator section 12 because the inner diameter 26 of the evaporator section 12 is the same as the inner diameter 42 of the inner surface 40.

Heat can conduct from the evaporator section 12 directly to the evaporator portions 16B because the evaporator portions 16B are located directly against one another and against the evaporator section 12. Some of the evaporator portions 16B are also exposed toward a center of the evaporator section 12 because the inner retaining wall 30 ends at the interface 50.

The intermediate portions 16A are held in position between the outer surface 44 and the inner surface 40. The intermediate portions 16A are in four bundles, each bundle within a respective one of the spaces 48. Small spaces between the intermediate portions 16A are maintained when the heat pipe 10 is bent. Because the small spaces are maintained, capillary forces between the intermediate portions 16A and a liquid flowing through the small spaces are substantially the same before and after the heat pipe 10 is bent.

The metal foil transition sheath 20 is used to secure the intermediate structure 14 to the evaporator section 12. The metal foil transition sheath 20 is located around the intermediate structure 14 and a portion only of the evaporator section 12. The plastic transition sheath protector 22 is located between the intermediate structure 14 and the metal foil transition sheath 20, so that the metal foil transition sheath 20 does not damage the intermediate structure 14. The plastic transition sheath protector 22 is located around the metal foil transition sheath 20 and serves to protect the metal foil transition sheath 20. Because the metal foil transition sheath 20, plastic outer structure structural wall protector 18, and plastic transition sheath protector 22 are located over a portion only of the evaporator section 12, an outer metal surface of the evaporator section 12 is exposed for purposes of reducing thermal resistance.

As stated, only one-half of the heat pipe 10 is illustrated in FIG. 1. The other half of the heat pipe 10 is exactly the same as the half illustrated in FIG. 1, and the heat pipe 10 is symmetrically the same on the left and the right of the center line 54.

Figure 2:
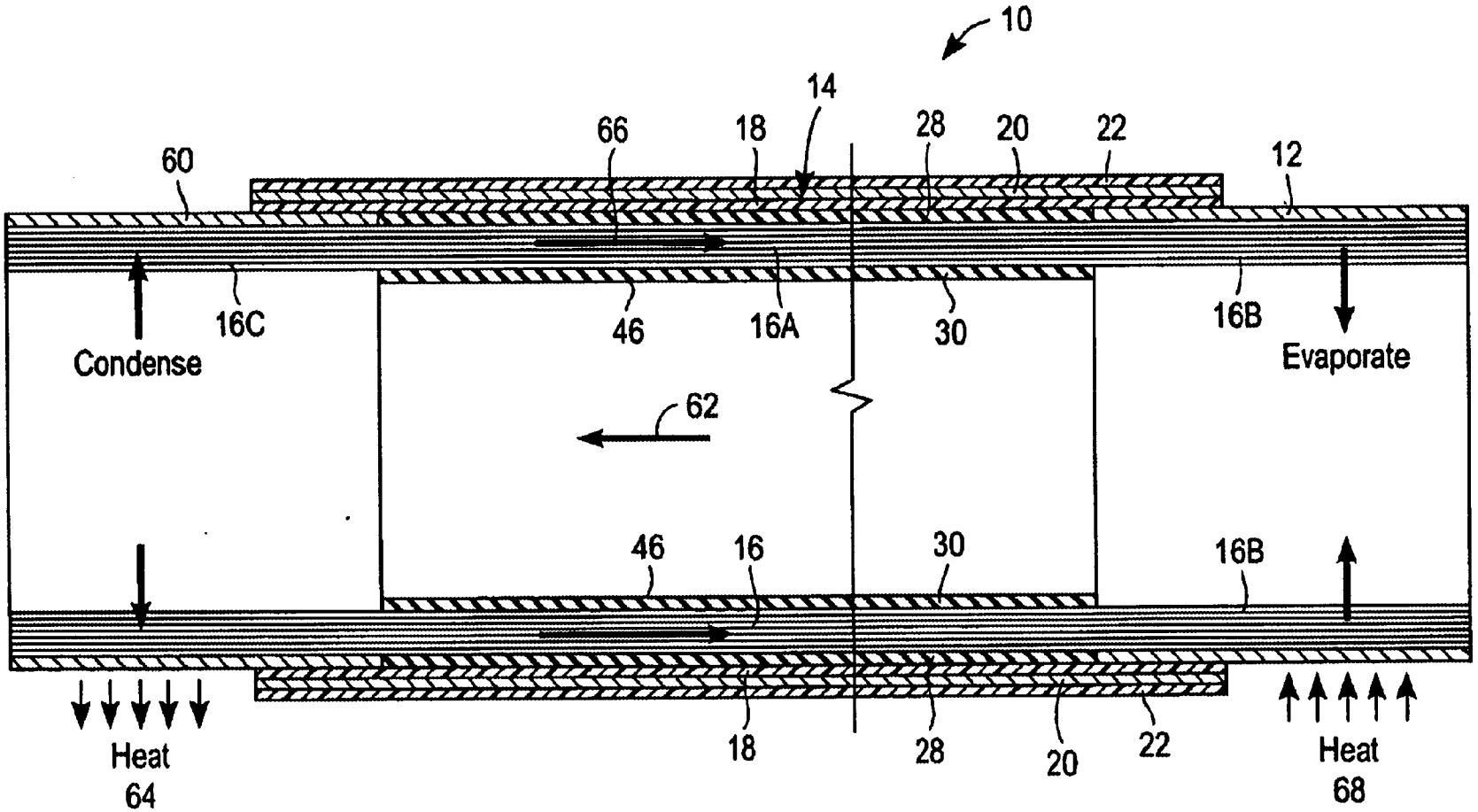
FIG. 2 is a cross-sectional side view through the heat pipe from end to end.

As illustrated in FIG. 2, the heat pipe 10 additionally has a condenser section 60 on a side of the intermediate structure 14 opposing the evaporator section 12. The condenser section 60 is exactly the same as the evaporator section 12 and is secured to the intermediate structure 14 by the metal foil transition sheath 20, together with the same plastic outer structural wall protector 18 and the plastic transition sheath protector 22. Each elongate wicking wire 16 has a condenser portion 16C in the condenser section 60.

In use, a vapor flows from right to left in a direction 62 over the inner surface 46 through the intermediate structure 14 into the condenser section 60. Heat 64 convects from the vapor to the condenser portions 16C and conducts through the condenser portions 16C to the condenser section 60. The heat 64 is then transferred from an outer surface of the condenser section 60. The vapor condenses as a liquid onto the condenser portions 16C, and the liquid penetrates into small spaces between the condenser portions 16C.

The liquid subsequently flows under capillary action and due to capillary forces through small spaces between the intermediate portions 16A that are located between the intermediate section 28 and the inner retaining wall 30 in a direction 66 back to the evaporator section 12.

More heat 68 is transferred through an external surface of the evaporator section 12 and conducts through a wall of the evaporator section 12 to the evaporator portions 16B. The heat 68 evaporates the liquid so that the liquid becomes a vapor within a center of the evaporator section 12. The vapor then recirculates in the direction 62 back to the condenser section 60.

While certain exemplary embodiments have been described and shown in the accompanying drawings, it is to be understood that such embodiments are merely illustrative and not restrictive of the current invention, and that this invention is not restricted to the specific constructions and arrangements shown and described since modifications may occur to those ordinarily skilled in the art.

What is claimed:

1. A heat pipe, comprising:

at least one outer structural wall having condenser, intermediate, and evaporator sections sequentially after one another;

a wicking structure in the outer structural wall, including a plurality of wicking components onto which a fluid condenses at the condenser section when heat transfers therefrom out through the condenser section, flows thereon through the intermediate section, and evaporates at the evaporator section therefrom when heat transfers thereto through the evaporator section; and an elongate inner retaining wall bending with the outer structural wall, the wicking components being held in place between the intermediate section and an outer surface of the inner retaining wall and the fluid evaporating at the evaporator section recirculating past an inner surface of the inner retaining wall back to the condenser section with the inner retaining wall forming an elongate separation between the fluid flowing over the inner and outer surfaces thereof.

2. The heat pipe of claim 1, wherein the wicking components are elongate components, each having condenser, intermediate, and evaporator portions in the condenser, intermediate, and evaporator sections respectively.

3. The heat pipe of claim 1, further comprising at least one connecting piece in the intermediate section between the intermediate section and the inner retaining wall to align the inner retaining wall relative to the outer structural wall.

4. The heat pipe of claim 3, wherein the connecting piece is secured to the intermediate section and the inner retaining wall.

5. The heat pipe of claim 3, comprising a plurality of connecting pieces dividing the wicking components into separate bundles.

6. The heat pipe of claim 3, wherein the intermediate section, the inner retaining wall, and the connecting pieces are in the form of a single intermediate structure made of the same material.

7. The heat pipe of claim 6, wherein the intermediate structure is made of a material which is more flexible but having a lower thermal conductivity than the condenser and evaporator sections.

8. The heat pipe of claim 7, wherein the intermediate structure is made of a nonmetal and the condenser and evaporator sections are made of a metal.

9. The heat pipe of claim 8, wherein no structure is located between the condenser section and the wicking components having a higher thermal conductivity than the condenser section.

10. The heat pipe of claim 7, further comprising a transition sheath around the outer structural wall, and over at least a portion of a length of the intermediate section and over a portion only of a length of the condenser section, to secure the intermediate section and the condenser section to one another.

11. The heat pipe of claim 7, further comprising a transition sheath around the outer structural wall, and over at least a portion of a length of the intermediate section and over a portion only of a length of the evaporator section, to secure the intermediate section and the evaporator section to one another.

12. The heat pipe of claim 10, wherein the transition sheath is a metal foil, further comprising a plastic transition sheath protector over the transition sheath.

13. The heat pipe of claim 10, wherein the transition sheath is a metal foil, further comprising a plastic outer structural wall protector located between the outer structural wall and the transition sheath.

14. A heat pipe, comprising:

spaced metal condenser and evaporator sections;

an intermediate structure secured between the condenser and evaporator sections, the intermediate structure including an intermediate section, an elongate inner retaining wall within the intermediate section and bendable with the intermediate section, and at least one connecting piece between the intermediate section and the inner retaining wall to align the inner retaining wall relative to and secure the inner retaining wall to the intermediate section; and a plurality of elongate wicking components, each having condenser, intermediate, and evaporator portions in the condenser, intermediate, and evaporator sections respectively, the intermediate portions being held in place in the intermediate section between an inner surface of the intermediate section and an outer surface of the inner retaining wall, a recirculation path being defined wherein a fluid in the condenser section condenses on the condenser portions, flows on the intermediate portions between the intermediate section and the inner retaining wall, evaporates from the evaporator portions in the evaporator section, and flows on a side of the inner retaining wall opposing the intermediate portions from the evaporator section back to the condenser section.

15. The heat pipe of claim 14, further comprising a transition sheath around and over at least a portion of a length of the intermediate section and over a portion only of a length of the condenser section, to secure the intermediate section and the condenser section to one another.

16. The heat pipe of claim 14, wherein the intermediate structure is made of a material which is more flexible but having a lower thermal conductivity than the condenser and evaporator sections.

17. A heat pipe, comprising:

spaced metal condenser and evaporator sections having a first stiffness and a first thermal conductivity;

an intermediate structure secured between the condenser and evaporator sections, the intermediate structure including an intermediate section, an inner retaining wall within the intermediate section, and at least one connecting piece between the intermediate section and the inner retaining wall to align the inner retaining wall relative to and secure the inner retaining wall to the intermediate section, the intermediate structure bring made of a nonmetal having a second stiffness which is less than the first stiffness and having a second thermal conductivity which is less than the first thermal conductivity; and a transition sheath around and over at least a portion of a length of the intermediate section and over a portion only of a length of the condenser section, to secure the intermediate section and the condenser section to one another.

18. The heat pipe of claim 17, comprising a plurality of connecting pieces dividing the wicking components into separate bundles.

19. The heat pipe of claim 17, wherein the transition sheath is a metal foil, further comprising a plastic transition sheath protector over the transition sheath.

20. The heat pipe of claim 17, wherein the transition sheath is a metal foil, further comprising a plastic outer structural wall protector located between the outer structural wall and the transition sheath.

21. A heat pipe, comprising:

at least one outer structural wall having condenser, intermediate, and evaporator sections sequentially after one another;

a wicking structure in the outer structural wall, including a plurality of wicking components onto which a fluid condenses at the condenser section when heat transfers therefrom out through the condenser section, flows thereon through the intermediate section, and evaporates at the evaporator section therefrom when heat transfers thereto through the evaporator section; and an inner retaining wall, the wicking components being held in place between the intermediate section and an outer surface of the inner retaining wall and the fluid evaporating at the evaporator section recirculating past an inner surface of the inner retaining wall back to the condenser section, wherein the intermediate section, the inner retaining wall, and the connecting pieces are in the form of a single intermediate structure made of the same material.

22. The heat pipe of claim 21, wherein the intermediate structure is made of a material which is more flexible but having a lower thermal conductivity than the condenser and evaporator sections.

23. The heat pipe of claim 22, wherein the intermediate structure is made of a nonmetal and the condenser and evaporator sections are made of a metal.

24. The heat pipe of claim 23, wherein no structure is located between the condenser section and the wicking components having a higher thermal conductivity than the condenser section.

25. The heat pipe of claim 22, further comprising a transition sheath around the outer structural wall, and over at least a portion of a length of the intermediate section and over a portion only of a length of the condenser section, to secure the intermediate section and the condenser section to one another.

26. The heat pipe of claim 22, further comprising a transition sheath around the outer structural wall, and over at least a portion of a length of the intermediate section and over a portion only of a length of the evaporator section, to secure the intermediate section and the evaporator section to one another.

27. The heat pipe of claim 26, wherein the transition sheath is a metal foil, further comprising a plastic transition sheath protector over the transition sheath.

28. The heat pipe of claim 26, wherein the transition sheath is a metal foil, further comprising a plastic outer structural wall protector located between the outer structural wall and the transition sheath.

* * * * *